US005997196A

United States Patent [19]

Hu

[11] Patent Number: 5,997,196

[45] Date of Patent: Dec. 7, 1999

[54] KEY STRUCTURE OF COMPUTER KEYBOARD

[75] Inventor: Gino Hu, Taipei, Taiwan

[73] Assignee: Silitek Corporation, Taipei, Taiwan

[21] Appl. No.: 09/215,541

[22] Filed: Dec. 18, 1998

[51] Int. Cl.[6] ..... B41J 5/08

[52] U.S. Cl. ..... 400/495; 400/490

[58] Field of Search ..... 400/495, 473, 400/472, 490, 491, 492, 191.2; 361/680

[56] References Cited

U.S. PATENT DOCUMENTS

| | | | |
|---|---|---|---|
| 5,519,569 | 5/1996 | Sellers | 400/490 |
| 5,602,715 | 2/1997 | Lempicki et al. | 400/490 |
| 5,642,950 | 7/1997 | Hochgesang et al. | 400/490 |
| 5,812,116 | 9/1998 | Malhi | 400/490 |
| 5,842,798 | 12/1998 | Su | 400/472 |
| 5,874,696 | 2/1999 | Hayashi et al. | 400/490 |

*Primary Examiner*—Ren Yan
*Assistant Examiner*—Anthony H. Nguyen
*Attorney, Agent, or Firm*—Rosenberg, Klein & Lee

[57] ABSTRACT

A key structure of computer keyboard having a base, a conductive film, an elastic member, a frame, a cap. A plurality of coupling parts are arranged on the cap and the base, wherein the coupling part on along the same side of the cap and the base are composed of three sliding grooves and a fixed groove. The frame has a plurality of pivoting shafts arranged within the sliding grooves and fixed groove such that the frame can be pressed down. Both sides of the elastic member are fixed between the cap and the conductive film such that the elastic member will not outleap. A clamping device is arranged between the cap and the base such that the key will not shake when being pressed.

7 Claims, 6 Drawing Sheets

KEY STRUCTURE OF COMPUTER KEYBOARD

FIELD OF THE INVENTION

The present invention relates to a key structure computer keyboard, especially to a key structure of computer keyboard having a base, a conductive film, an elastic member, a frame, a cap, three sliding grooves and a fixed groove on the same side, whereby the key will not shake when being pressed.

BACKGROUND OF THE INVENTION

The keys 20 in a conventional keyboard, as shown in FIG. 8, comprises a metal base 81, a conductive film 82, a plastic plate 83, an elastic member 84, a frame 85 and a cap 86. Moreover, corresponding coupling part 811 and 861 are arranged on the metal base 81 and the cap 86, respectively. The frame 85 comprises a first rack 851 and a second rack 852 pivotably connected to each other. Two locking part 853 and 854 corresponding to the coupling part 811 and 861 of the metal plate 81 and cap 86 are arranged on the first rack 851 and the second rack 852, respectively, whereby the cap 86 moves upward and downward.

However, the conventional keys 20 lie on the elastic member 84 and have no supporting elements on lateral sides thereof. The keys 20 are wont to shake when being pressed.

Therefore, it is the object of the present to provide a key structure of computer keyboard which does not shake when being pressed.

It's another object of the invention to provide a key for computer keyboard the elastic member thereof will not outleap when the key is opened for repair.

To achieve above objects, the present invention provide a key structure of computer keyboard having a base, a conductive film, an elastic member, a frame, a cap. A plurality of coupling parts are arranged on the cap and the base, wherein the coupling part on along the same side of the cap and the base are composed of three sliding grooves and a fixed groove. The frame has a plurality of pivoting shafts arranged within the sliding grooves and fixed groove such that the frame can be pressed down. Both sides of the elastic member are fixed between the cap and the conductive film such that the elastic member will not outleap. A clamping device is arranged between the cap and the base such that the key will not shake when being pressed.

The various objects and advantages of the present invention will be more readily understood from the following detailed description when read in conjunction with the appended drawing, in which:

DETAILED DESCRIPTION OF PREFERRED EMBODIMENT

Figure 1:
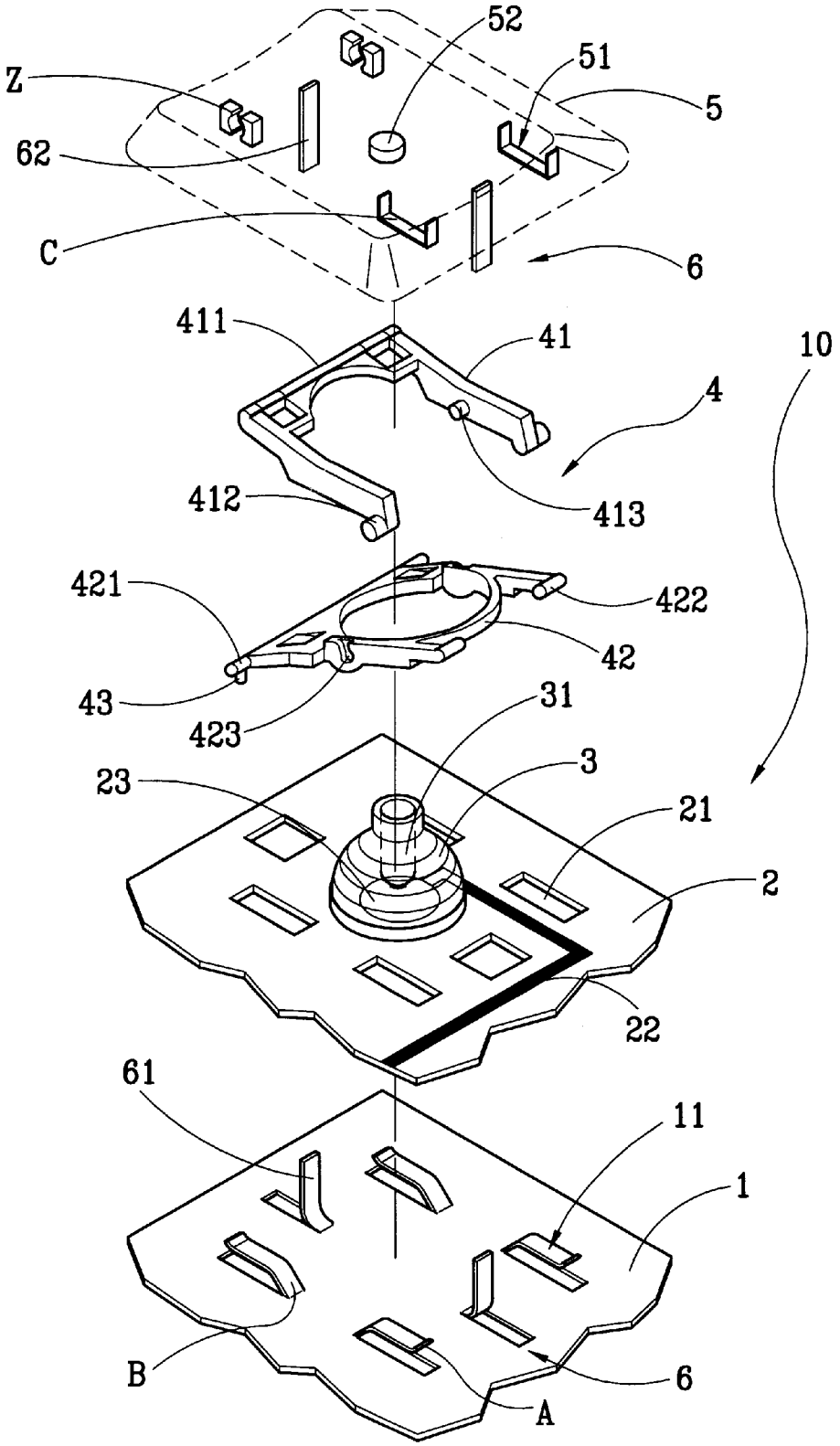
FIG. 1 is an exploded view of the present invention.

As shown in FIG. 1, the inventive key 10 comprises a base 10, a conductive film 2, an elastic member 3, a frame 4 and a cap 5. Moreover, four coupling parts 11, 51 are arranged on the bases 1 and cap 5, respectively. The coupling parts 11 and 51 along the same side of the base 1 and cap 5 are composed of three sliding grooves A, B and C, and a fixed groove Z. In this preferred embodiment, the fixed groove Z is arranged on the left side of the cap 5.

Figure 2:
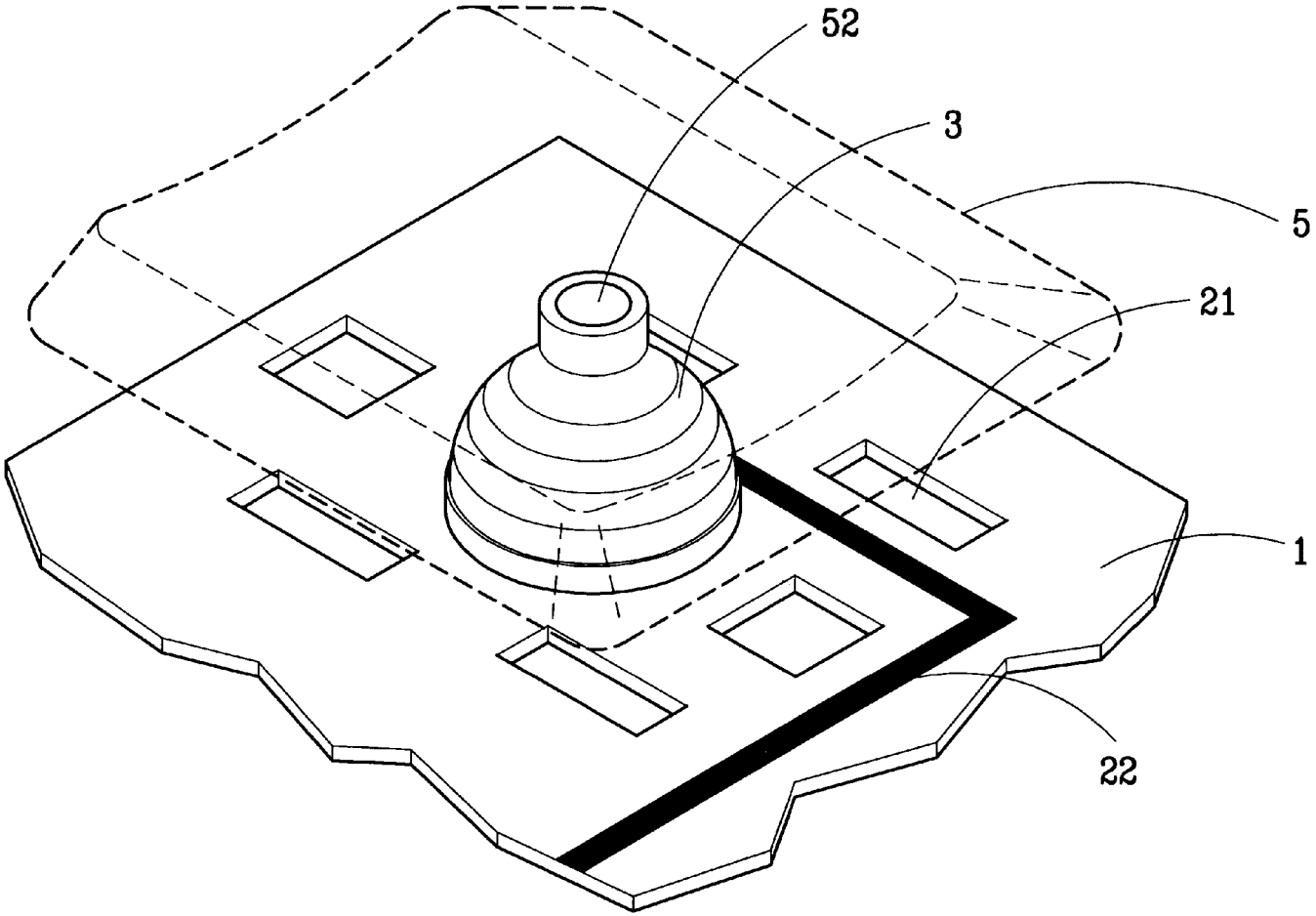
FIG. 2 show the state of the elastic element attached between the cap and the conductive film according to the present invention.

The conductive film 2 is arranged upon the base 1 and has an opening 21 corresponding to the coupling part 11 of the base 1 such that the coupling part 11 projects from the opening 21 when the conductive film 2 is put upon the base 1. The conductive film 2 is provided with circuit 22 and electric contact 23. As shown in FIG. 2, the elastic member 3 is placed between the conductive film 2 and the bump 52 of the cap 5. The elastic member will be pushed down when the cap 5 is pressed, and at this time, the conductive pin 31 of the elastic member 3 is in contact to the elastic contact 23 of the conductive film 2.

The frame 4 comprises a first rack 41 and a second rack 42 which are pivotably connected. The width of first rack 41 is slightly larger than that of the second rack 42 such that the first rack 41 can be pivotably arranged on the outer side of the second rack 42. The first rack 41 is of a U-shape and has a shaft 411 on the closed end thereof and engaged into the two fixing groove Z on the left side of the cap 5, and poles 412 extending on the opened end of the first rack 41 and engaged into the sliding groove A on the right side of the base 1. Moreover, the first rack 41 has tie 413 projecting on the center part of its arms. Both sides of the second rack 42 are provided with pivoting shaft 421 and 422 engaged within the sliding groove B on left side of the base 1 and the sliding groove C on the right side of the cap 5. Moreover, the second rack 42 has a engaging groove 423 corresponding to the tie 413 of the first rack 41 such that the tie 413 can be pivotably arranged within the engaging groove 423.

In the present invention, a clamping means is provided between the base 1 and the cap 5 wherein the clamping means 6 comprises a first blocking plate 61 on the left and right side of the base 1, respectively, and second blocking plate 62 on the cap 5 and attached with the first blocking plate 61. By the attachment of the first blocking plate 61 and the second blocking plate 62, the cap 5 can be prevented from shaking.

Figure 3:
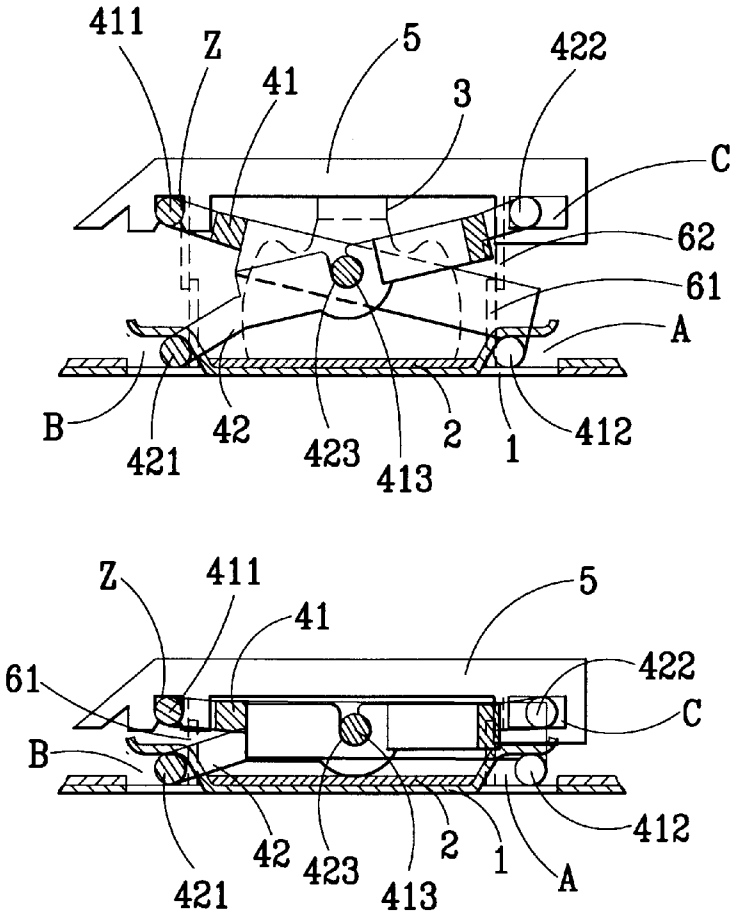
FIG. 3 is a cross-section view showing an embodiment of the present invention.

With reference now to FIG. 3, this figure shows the cross section view of a preferred embodiment of the present invention. As shown in FIG. 3, the fixed groove Z is arranged on the left side of the cap 5 such that the pivoting shaft 411, 412, 421, 422 of the first rack 41 and the second rack 42 can be engaged within the coupling parts 11 and 51 of the base 1 and the cap 5, respectively. The both ends of the elastic member 3 are attached to the bump 52 of the cap 5 and the conductive film 2. Moreover, the first blocking plate 61 on the base 1 is attached to the second blocking plate 62 on the cap 5. When the cap 5 is pressed down by user, the pivoting shafts 412, 421, 422 within the sliding groove are moved toward one side with the tie 413 as pivot. The cap 5 is therefore moved down to press the elastic member. The conductive pin 31 of the conductive film 2 within the elastic member 3 touches the conductive connection, thus forming conductive loop.

Figure 4:
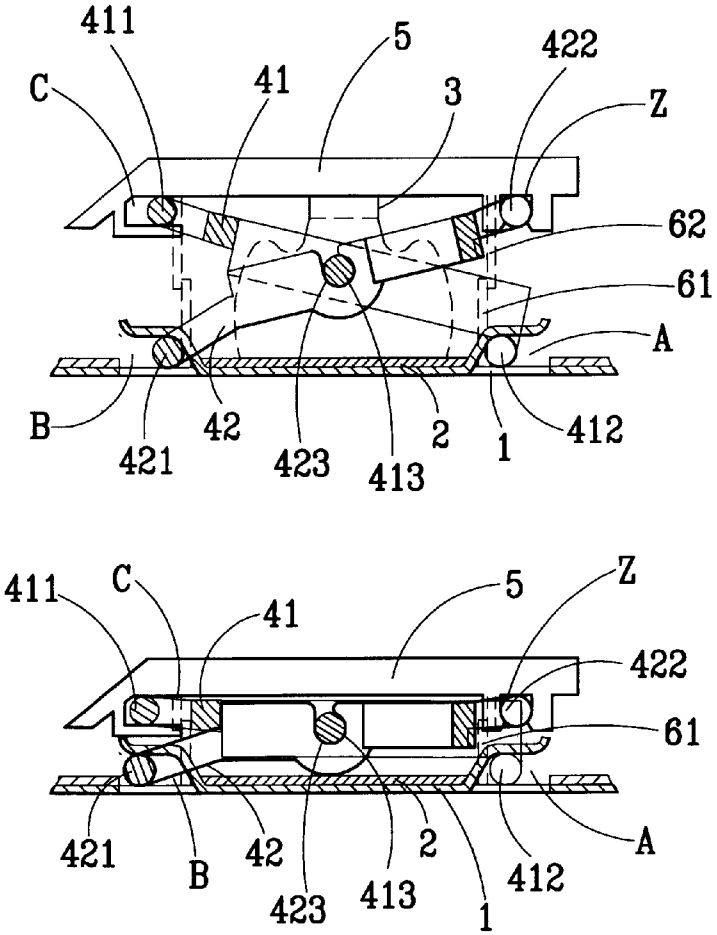
FIG. 4 is a cross-section view showing another embodiment of the present invention.

FIG. 4 shows another embodiment of the present invention. The fixed groove Z is placed at the upper-right position, that is, the coupling part 51 on the right side of the cap 5 is the fixed groove. The pivoting shaft 422 arranged on the right side the second rack 42 is not slidable, the other pivoting shafts 411, 421 and 422 are slidable. Therefore, the first and second rack 41 and 42 can be move downward.

Figure 6:
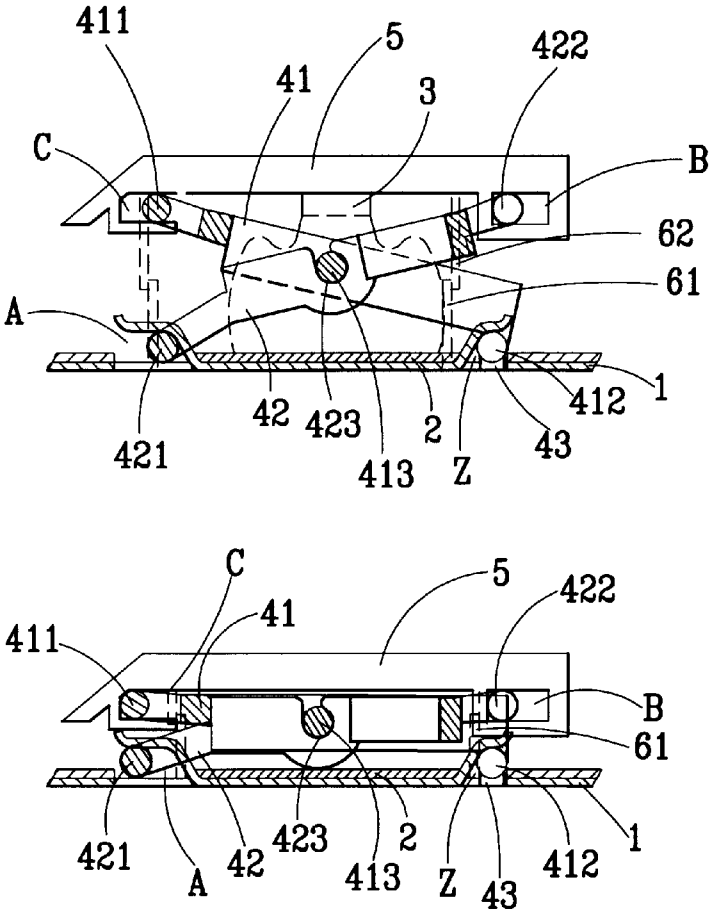
FIG. 6 is a cross-section view showing still another embodiment of the present invention.
Figure 5:
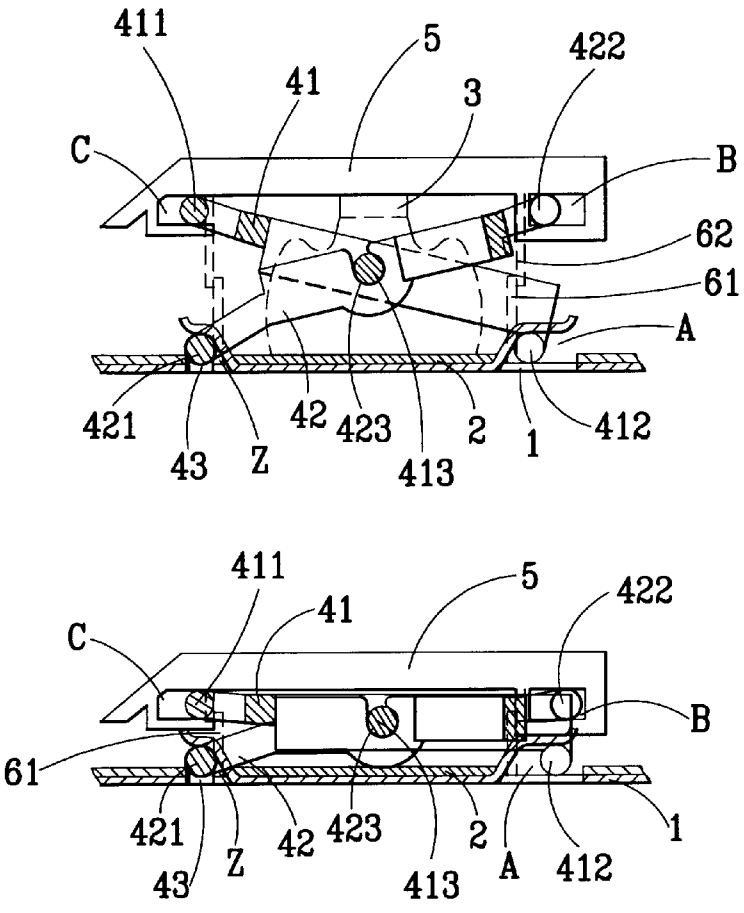
FIG. 5 is a cross-section view showing still another embodiment of the present invention.

FIG. 5 shows still another embodiment of the present invention. The fixed groove Z is placed on the left side of the base 1. That is, the coupling part 11 on the left side of the base 1 is functioned as fixed groove Z. The pivoting shaft 421 on the left side of the second rack 42 is not slidable. Furthermore, FIG. 6 shows still another preferred embodiment of the present invention. The fixed groove Z is designed to be on the right side of the base 1. That is, the coupling part 11 on the right side of the base 1 is functioned as the fixed groove. The pivoting shaft 412 on the right side of the first rack 441 is not slidable.

Figure 7:
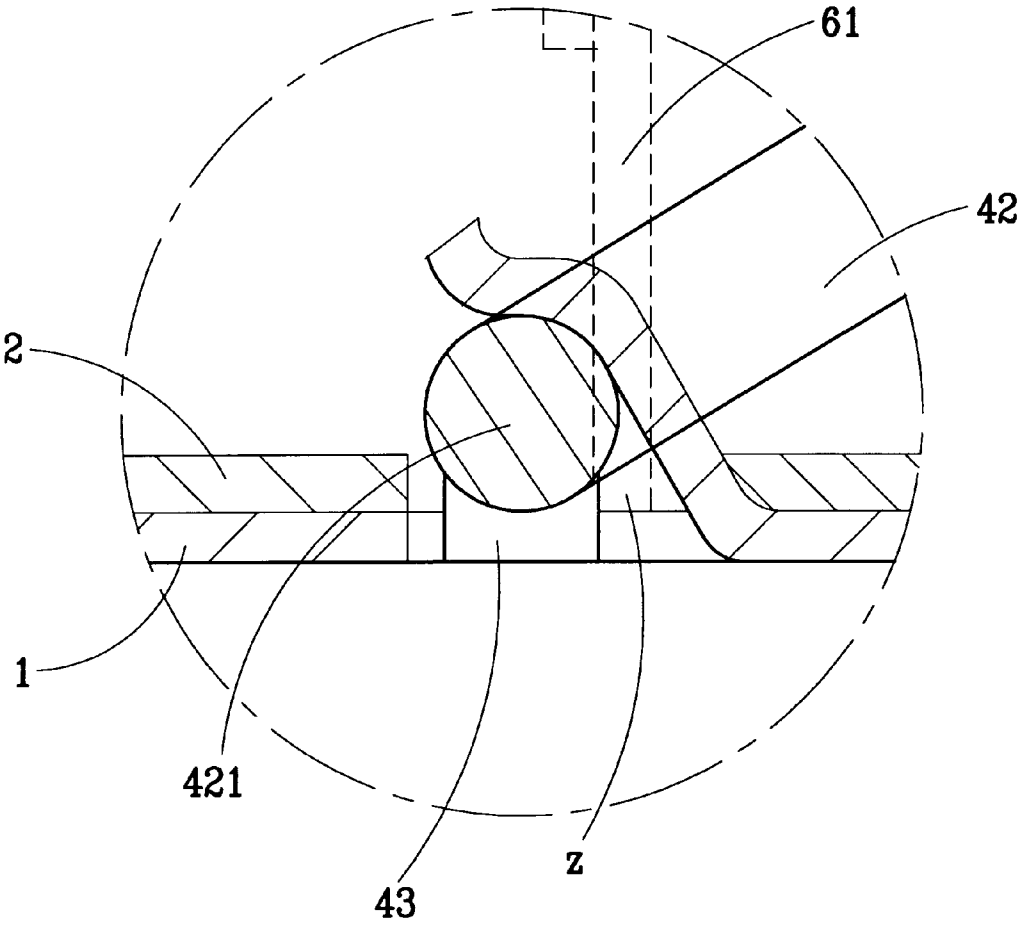
FIG. 7 is a partially enlarged view of the FIG. 5
Figure 8:
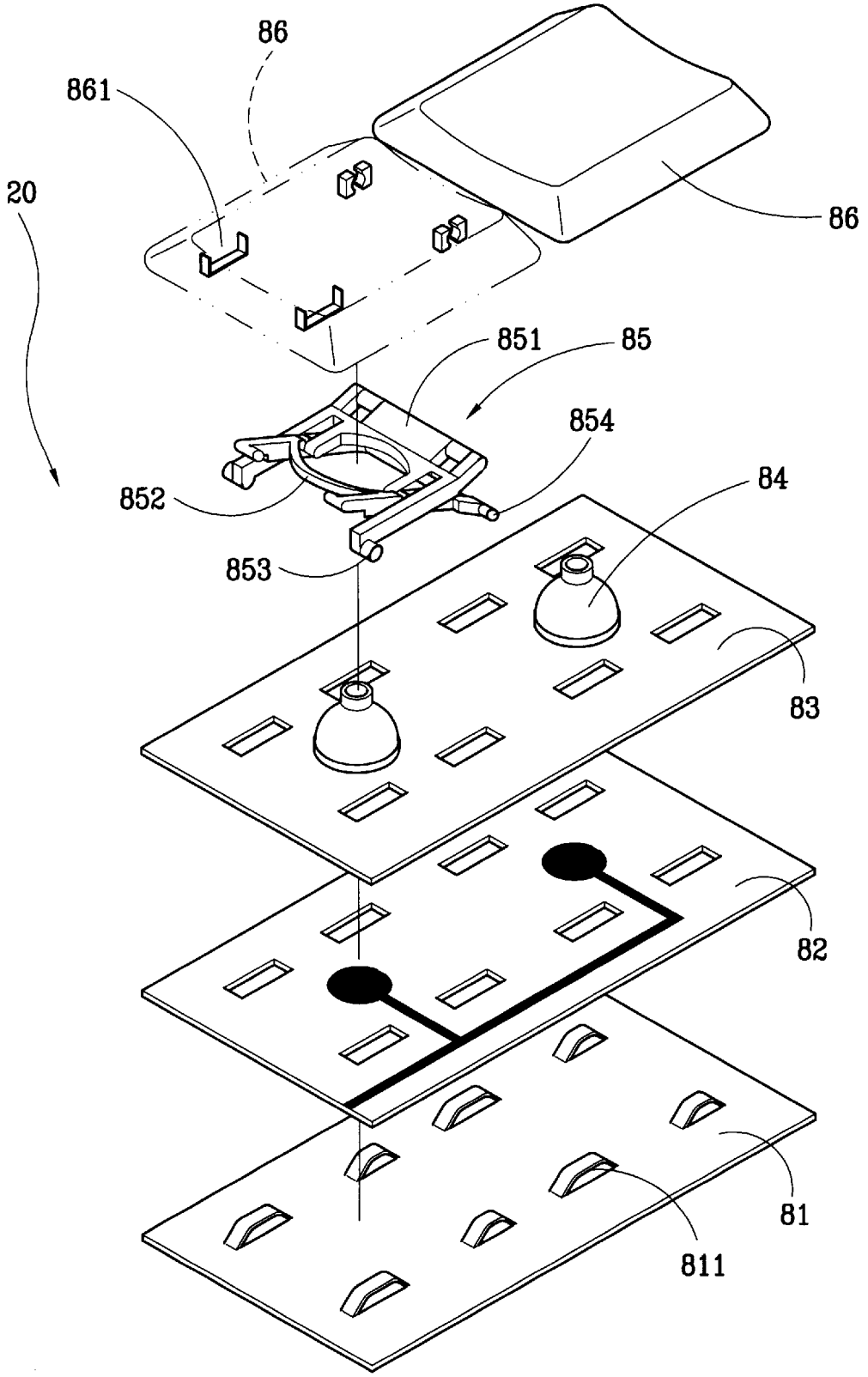
FIG.8 PRIOR ART
FIG. 8 is an exploded view of a conventional key.

With reference now to FIGS. 1 and 7, when the coupling part 11 on the base 1 is functioned as a fixed groove Z, a blocking pole 43 extends downward from the pivoting shaft 412 of the first rack 41 or the pivoting shaft 421 of the second rack 42 such that the pivoting shaft 412 or 421 can be prevented from releasing out of the fixed groove Z of the base 1. As shown in FIG. 7, the fixed groove Z is provided on the left side of the base 1, therefore, the pivoting shaft 421 of the second rack 42 is provided with downward extending blocking pole 43.

In the present invention, a clamping means 6 is provided between the cap 5 and the base 1 such that the cap 5 will not shake when the key 10 is pressed. In other word; the key 10 can be stably pressed. The keyboard in the present invention does not adopt conventionally-used plastic plate, the assembling of the keyboard 10 is more convenient. Moreover, both end of the elastic member are attached between the bump 52 of the cap 5 and the conductive film 2. The elastic member 3 will not outleap when the keyboard 10 is disassembled.

Although the present invention has been described with reference to the preferred embodiment thereof, it will be understood that the invention is not limited to the details thereof Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A key of a computer keyboard, said key comprising:

a base having a plurality of coupling parts and a conductive film, an elastic member, a frame and a cap;

said conductive film having openings at locations corresponding to the positions of said coupling parts of said base, said coupling parts projecting from said openings when said conductive film is placed upon said base, said conductive film having electric circuits and electric contacts;

said frame having a first rack and a second rack, said racks being pivotally arranged in cross relationship each to the other, both sides of said first and second rack being provided with pivoting shafts;

said cap having coupling parts including a fixed groove and three sliding grooves which cooperate with said coupling parts of said base, the pivoting shafts of the first rack and the second rack being pivotally arranged into said coupling parts of said cap and said coupling parts of said base, respectively;

an elastic member having two ends and a conductive pin, both ends of said elastic member being connected to said conductive film and said cap, the conductive pin of said elastic member contacting one of said electric contacts of said conductive film when said elastic member is pressed; and, clamping means arranged between said base and said cap to prevent said cap from shaking when said key is pressed.

2. The key as in claim 1, wherein said first rack is of U-shape, the closed end thereof having a pivoting shaft engaged into said coupling part on left side of said cap; the opened end thereof having outward extending pivoting shaft engaged into said coupling part on right side of said base, said second rack having pivoting shafts on both end thereof to engage into said coupling part on the right side of the cap and the left side of the base, respectively, said second rack having engaging groove at location corresponding to said tie of said first rack such that said tie is engaged into said engaging groove.

3. The key as in claim 1, wherein said clamping means comprises first blocking plate arranged on the left side and right side of said base, said cap having a second blocking plate arranged on location corresponding to said first blocking plate and leaning with said first blocking plate.

4. The key as in claim 1, wherein the coupling part on the left side of said cap is a fixed groove, and the coupling part on the right side of said cap, on the right and left side of said base are sliding groove.

5. The key as in claim 1, wherein the coupling part on the right side of said cap is a fixed groove, and the coupling part on the left side of said cap, on the right and left side of said base are sliding groove.

6. The key as in claim 1, wherein the coupling part on the left side of said base is a fixed groove, and the coupling part on the right side of said base, on the right and left side of said cap are sliding groove.

7. The key as in claim 1, wherein the coupling part on the right side of said base is a fixed groove, and the coupling part on the left side of said base, on the right and left side of said cap are sliding groove.

* * * * *